US010808476B2

(12) United States Patent
Purcell et al.

(10) Patent No.: US 10,808,476 B2
(45) Date of Patent: Oct. 20, 2020

(54) DRILL ROD FOR PERCUSSION DRILL TOOL

(71) Applicant: MINCON INTERNATIONAL LTD., Shannon, Co. Clare (IE)

(72) Inventors: Joseph Purcell, Ennis (IE); John Kosovich, Cahercalla (IE); Hongbin Wang, Shannon (IE)

(73) Assignee: MINCON INTERNATIONAL LTD., Shannon, Co. Clare (IE)

( * ) Notice: Subject to any disclaimer, the term of this patent is extended or adjusted under 35 U.S.C. 154(b) by 390 days.

(21) Appl. No.: 15/022,703

(22) PCT Filed: Sep. 19, 2014

(86) PCT No.: PCT/EP2014/070059
§ 371 (c)(1),
(2) Date: Mar. 17, 2016

(87) PCT Pub. No.: WO2015/040196
PCT Pub. Date: Mar. 26, 2015

(65) Prior Publication Data

US 2016/0230485 A1 Aug. 11, 2016

(30) Foreign Application Priority Data

Sep. 19, 2013 (GB) ..... 1316631.9

(51) Int. Cl.
*E21B 21/12* (2006.01)
*E21B 17/042* (2006.01)
(Continued)

(52) U.S. Cl.
CPC ..... *E21B 21/12* (2013.01); *E21B 1/00* (2013.01); *E21B 4/14* (2013.01); *E21B 17/042* (2013.01);
(Continued)

(58) Field of Classification Search
CPC . E21B 4/14; E21B 17/02; E21B 17/18; E21B 21/12
See application file for complete search history.

(56) References Cited

U.S. PATENT DOCUMENTS 4,694,911 A * 9/1987 Kennedy ..... E21B 4/14 173/62
5,823,274 A * 10/1998 Wisakanto ..... E21B 17/0426 175/215
(Continued)

FOREIGN PATENT DOCUMENTS

EP 0022865 A1 1/1981 ..... E21B 4/02
GB 2481848 A 1/2012 ..... E21B 21/10
WO WO-2010033041 A1 * 3/2010 ..... E21B 4/14

OTHER PUBLICATIONS

International Search Report issued in corresponding International Patent Application No. PCT/EP2014/070059, dated May 8, 2015.

*Primary Examiner* — Robert E Fuller
*Assistant Examiner* — Lamia Quaim
(74) *Attorney, Agent, or Firm* — Kusner & Jaffe

(57) ABSTRACT

The present invention relates to a drill rod (2) for a fluid-operated apparatus, particularly a percussion drill tool (1). The drill rod (2) comprises a first connection interface (100) at a first end (101) and a second connection interface (102) at a second end (103). The first connection interface (100) is for connection of the drill rod (2) to a second connection interface (102) of a like drill rod (3) or to the apparatus (1). The second connection interface (102) is for connection of the drill rod (2) to a first connection interface of a like drill rod (3) or to a fluid transfer device. The drill rod also comprises a plurality of discrete fluid flow channels (4, 6, 8) through the drill rod, a first member (23) moveably mounted in the first connection interface (100) and a second member (22) moveably mounted in the second connection interface.
(Continued)

The first moveable member is the innermost component in the first connection interface and the second moveable member is the innermost component in the second connection interface. When the drill rod (2) is connected to a like drill rod (3) or to the apparatus (1) or to the fluid transfer device, at least two of the fluid flow channels (4, 6) are placed in fluid communication with corresponding channels (4, 6) of the like drill rod or the apparatus or the fluid transfer device by movement of the first (23) and second (22) moveable members only.

22 Claims, 9 Drawing Sheets

(51) Int. Cl.

| | |
|---|---|
| ***E21B 21/10*** | (2006.01) |
| ***E21B 17/18*** | (2006.01) |
| ***E21B 4/14*** | (2006.01) |
| ***E21B 1/00*** | (2006.01) |
| ***E21B 17/07*** | (2006.01) |

(52) U.S. Cl.
CPC ..... *E21B 17/0426* (2013.01); *E21B 17/07* (2013.01); *E21B 17/18* (2013.01); *E21B 21/10* (2013.01)

(56) References Cited

U.S. PATENT DOCUMENTS

2006/0283606 A1* 12/2006 Partouche ..... E21B 17/02 166/380
2012/0247839 A1* 10/2012 Kosovich ..... E21B 4/14 175/296
2013/0068473 A1* 3/2013 Tunget ..... E21B 41/0035 166/373
2013/0181439 A1* 7/2013 Alhaug ..... E21B 17/042 285/123.12
2015/0136492 A1* 5/2015 Speer ..... E21B 21/12 175/70

* cited by examiner

Pressure Fluid Flow Path

DRILL ROD FOR PERCUSSION DRILL TOOL

RELATED APPLICATIONS

This application is a National Stage of International Application No. PCT/EP2014/070059, filed Sep. 19, 2014, which claims the benefit of United Kingdom Patent Application No. 1316631.9, filed Sep. 19, 2013.

FIELD OF THE INVENTION

The present invention relates to fluid-powered apparatus such as percussion drill tools, including down-the-hole hammers, and, in particular, to drill rods for liquid-powered down-the-hole hammers.

BACKGROUND TO THE INVENTION

The drilling of holes in high-strength rock using down-the-hole (DTH) percussive hammers is a well-established technique. There are a variety of such hammers in common use, for a wide variety of drilling applications. Virtually all of these commonly used hammers are of an "open circuit" design, in which a pressurised fluid is used to transmit energy to the hammer and then the same fluid, once it has been exhausted from the percussion mechanism, is used to flush the drill cuttings from the hole being drilled. Air is the most commonly used fluid in such hammers, and, in most cases, is a very suitable flushing medium. However, such pneumatically powered hammers are energy inefficient and often suffer performance constraints, especially when drilling small diameter holes.

In an effort to improve energy efficiency and performance, liquid-powered hammers have been developed. These include both open circuit water powered designs and designs that use special fluids known as drilling "muds". These liquid-powered designs have shown significant advantages over pneumatic designs in relation to both energy efficiency and performance. However, there are a number of disadvantages of open circuit designs, even those that are liquid powered.

A first disadvantage is that there is no independent control of the flushing flow rate vs. the percussion mechanism flow rate. The minimum flushing flow rate is the percussion flow rate. However, the fluid flow rate required to efficiently flush the hole may vary greatly from that needed to efficiently drive the percussion mechanism. Whenever there is a large variance between the two requirements, energy will be wasted and/or hammer performance will be compromised.

Another disadvantage is that the choice of fluid to drive the hammer is limited to those that are suitable for both driving the percussion mechanism and flushing the hole. This almost always results in the use of a fluid that is not optimal for either purpose. For instance, oil is the preferred fluid to drive the percussion mechanism as it has a wide working temperature range, and good lubrication and anti-corrosion properties. However, for obvious environmental and economic reasons, it is not suitable for flushing the drilled hole. On the other hand, water may be suitable for flushing the hole, but is generally a poor choice for use in the percussion mechanism.

A further disadvantage of open circuit systems is that the fluid chosen to drive the hammer must be available in large quantities, or must be recycled once it exits the drilled hole. This is a significant disadvantage for many drilling applications, since either the drill rig must be connected to an adequate supply of fresh fluid or it must utilise a complicated fluid capture and filtration system. In most situations, both are required, significantly reducing the mobility of such rigs.

In an effort to overcome these disadvantages, while retaining the performance and energy efficiency advantages of liquid-powered hammers, hammers that operate on a "closed-circuit" principle have been proposed. In these designs, the flushing fluid flow is separate from the pressure fluid flow used to drive the hammer. The pressure fluid, rather than being exhausted into the drilled hole, is returned directly to the prime mover for reuse, as a return fluid flow. There are many advantages of this arrangement.

A first advantage is that the flushing and pressure fluid flows may be independently controlled. Another advantage is that suitable fluids may be chosen for each of the percussion fluid flow and the flushing fluid flow, including combinations that utilise a gaseous flushing medium. In most cases, the preferred combination will be oil/air, or in some applications, oil/water, both of which are referred to as hydraulic DTH. A further advantage is that if clean flushing fluid is not available in sufficient quantities it may be recycled without the stringent cleanliness requirements of open circuit designs. Yet another advantage is that drill rig mobility is improved, because large supplies of fresh fluid or recycling systems are not required.

However, despite their advantages, closed circuit liquid-powered hammers have not found common use to date. The main reason for this is that the drill rods required to feed such hammers are complex and must fulfil a number of requirements. First, the drill rods must create three discrete fluid flow paths simultaneously on connection for the pressure, return and flushing fluid, and must reliably seal between the various flow paths during operation. The rods must also be robust enough to offer adequate service life in typical drilling environments. For drill rods to be used in hydraulic hammers, that is, where the percussion fluid is oil, they must be capable of storing the working fluid internally, without leakage, when disconnected, and must not allow the loss of significant quantities of working fluid while being connected or disconnected. The rods must also offer minimal restriction to all three fluid flows during use, since if the pressure loss between successive drill rods is excessive, the energy saving features of the hammer will be negated.

European Patent Application Publication No. 0 571 346 discloses a drill string component with three coaxial tubes that can be used with a liquid driven down-the-hole drill. The three tubes carry the three flows required for operation of the hammer. There are sealing arrangements between the tubes of adjacent rods to stop cross leakage between the flows while the rods are connected. However, there is no provision for storing the working fluid once adjacent rods are disconnected, which renders the drill rod disclosed in this document unsuitable for hydraulic DTH.

German Patent No. DE 40 27 414 discloses a concentric-style drill rod which has sealing arrangements to prevent fluid loss on disconnection. However, the design requires two moving parts in each half of the rod connections, to seal the pressure fluid and return fluid paths respectively. This reduces the strength of the connection between the hydraulic components, detrimentally affecting their reliability. Furthermore, the hydraulic components are not fully enclosed within the outer tube, which leaves them susceptible to damage.

International Patent Application Publication No. WO 96/08632 discloses a drill rod with side-by-side fluid paths with one moving part in each half of the rod connections and where the hydraulic connections are fully enclosed by the outer tube. It also includes closing means which close the hydraulic fluid transmitting paths when the rods are detached and automatically open the paths when the rods are connected to one another. However, the design has a very long engagement length of the hydraulic components and no adequate means of ensuring concentricity and angular alignment of the components as they engage. These disadvantages are further magnified by the fact that the seals in the connections sweep over ports as the components engage, thereby reducing reliability of the connection. In very cold or very hot climatic conditions, the connection is exposed to the negative effects of differential thermal expansion of the various components, which it does not allow for. Also, while there is only one moving component in each half of the connection, in one half it is the innermost component and in the other half, it is a surrounding component. This means that it is difficult to maintain sufficient open area to ensure that the pressure losses across the connection during operation are within acceptable limits.

SUMMARY OF THE INVENTION

According to an aspect of the present invention, there is provided a drill rod for a fluid-operated apparatus, the drill rod comprising:

a first connection interface at a first end and a second connection interface at a second end, wherein the first connection interface is for connection of the drill rod to a second connection interface of a like drill rod or to the apparatus, and the second connection interface is for connection of the drill rod to a first connection interface of a like drill rod or to a fluid transfer device;

a plurality of discrete fluid flow channels through the drill rod;

a first member moveably mounted in the first connection interface;

a second member moveably mounted in the second connection interface; and characterised in that the first moveable member is the innermost component in the first connection interface and the second moveable member is the innermost component in the second connection interface and, when the drill rod is connected to a like drill rod or to the apparatus or to the fluid transfer device, at least two of the fluid flow channels are placed in fluid communication with corresponding channels of the like drill rod or the apparatus or the fluid transfer device by movement of the first and second moveable members only.

The term "innermost" used herein indicates that each of the moveable members is the closest component in its respective connection interface to the centreline of the drill rod, that is, no other component is disposed or received within the moveable member.

In one embodiment, the first connection interface is a female connection interface and the second connection interface is a male connection interface. In alternate embodiments, this arrangement may be reversed. The drill rod of the present invention is ideally suited for use with a fluid-operated percussion drill tool such as a hydraulic down-the-hole hammer, but may also be used with any other fluid-powered device that needs to operate remotely. The fluid transfer device may also be a rotation device.

An advantage of this arrangement is that, by locating the moveable members along the centreline of the drill rod, when adjacent drill rods are connected so that at least two fluid flow channels are placed in fluid communication, the fluid flows as close to the centreline of the drill rod as possible. This allows maximum strength of the drill rod to be maintained while also maximising the area through which fluid may flow, thereby keeping pressure loss to a minimum.

In certain embodiments, when the drill rod is connected to a like drill rod or to the apparatus, there is substantially no overlap between the moveable members in an axial (longitudinal) direction of the drill rod.

This means, for example, that neither of the first and second moveable members is received within the other or overlaps the other in an axial (longitudinal) direction. In a preferred embodiment, the first moveable member has a substantially planar end face and the second moveable member has a substantially planar end face, and when the drill rod is connected to a like drill rod or the apparatus, the planar end faces abut one another.

An advantage of this arrangement is that, because there is no overlap between the moveable components, the cross-sectional area of the drill rod taken up by the moveable components is minimised, thereby allowing the open area (i.e. the area through which fluid may flow) to be maximised. This ensures that the pressure loss at each connection interface is kept to a minimum.

In an embodiment, the first moveable member is biasedly mounted in the first connection interface and the second moveable member is biasedly mounted in the second connection interface, such that when the drill rod is disconnected from like drill rods or the apparatus or from the fluid transfer device, the at least two fluid flow channels are sealed by the first and second moveable members. So when a drill rod is disconnected at the first end of the rod from a like drill rod or fluid operated apparatus, the at least two fluid flow channels are sealed by the first moveable member. When a drill rod is disconnected at the second end of the rod from a like drill rod or from the fluid transfer device, the at least two fluid flow channels are sealed by the second moveable member.

An advantage of this arrangement is that when the drill rods are disconnected, fluid contained in each drill rod is stored therein, thereby avoiding fluid loss on disconnection.

In an embodiment of the invention, the plurality of discrete fluid flow channels are concentrically arranged over at least a substantial portion of the length of the drill rod. This allows each fluid path to be as straight as possible, thereby avoiding pressure loss through the drill rod.

The plurality of discrete fluid flow channels may include at least a pressure fluid channel and a return fluid channel and, when the drill rod is connected to a like drill rod or to the apparatus or to the fluid transfer device, the pressure fluid channel and the return fluid channel may be placed in fluid communication with corresponding channels of a like drill rod or the apparatus or the fluid transfer device by movement of the first and second moveable members only and, when the drill rod is disconnected from a like drill rod or the apparatus or the fluid transfer device, the pressure and return fluid channels may be sealed by the first and second moveable members.

According to an embodiment of the invention, the drill rod further comprises:

an outer tube;

a middle tube, concentrically mounted within the outer tube; and a centre tube, concentrically mounted within the middle tube;

wherein the tubes provide three discrete fluid flow channels through the drill rod, and wherein the outer tube extends axially (longitudinally) beyond the ends of the middle tube and the centre tube.

Because the outer tube extends beyond the middle and centre tubes, potential damage to the middle and centre tubes is avoided.

In an embodiment, the first connection interface includes a female tool joint having a tapered thread at a first end of the outer tube and the second connection interface includes a male tool joint having a tapered thread at a second end of the outer tube, and the female tool joint is for threaded connection of the drill rod to a male tool joint of a like drill rod or to the apparatus, and the male tool joint is for threaded connection to a female tool joint of a like drill rod or to a fluid transfer device. In alternate embodiments, the female thread may be provided in the second connection interface and the male thread may be provided on the first connection interface.

An advantage of this arrangement is that the tapered thread has an aligning effect on the drill rods as they are brought together, allowing them to engage with one another even where there is significant axial misalignment.

In one embodiment, the drill rod further comprises:

at least one hydraulic component in the first connection interface, configured to carry pressure fluid through the drill rod and having an outlet for pressure fluid at an outwardly directed end thereof; and at least one hydraulic component in the second connection interface, configured to carry pressure fluid through the drill rod and having an inlet for pressure fluid at an outwardly directed end thereof;

wherein when the drill rod is connected to a like drill rod, or to the apparatus, or to the fluid transfer device, pressure fluid flows from the at least one hydraulic component in the first connection interface to the hydraulic component in the second connection interface and there is no overlap between the hydraulic components in an axial (longitudinal) direction of the drill rod.

The term "hydraulic component" used herein indicates a component through which working fluid may flow. The term "outward" used herein indicates outward in an axial or longitudinal direction of the drill rod (rather than a radial direction).

An advantage of this arrangement is that because there is no overlap between the hydraulic components in the first and second connection interfaces, the requirement to carefully control the concentricity of the connection interfaces as they are brought together is obviated. Since the components do not overlap, radial seals are not required and thus damage to such seals as the components move over one another is no longer a concern.

In an embodiment, the at least one hydraulic component in the first connection interface has a first substantially planar end face; and the at least one hydraulic component in the second connection interface has a second substantially planar end face; and when the drill rod is connected to a like drill rod, or to the apparatus, or to the fluid transfer device, the first and second planar end faces are brought into close proximity to one another. So, when the drill rod is connected at the first end to a like drill rod, or a fluid operated apparatus, the first planar end face of the drill rod is in close proximity to the second planar end face of the like drill rod, or to the fluid operated apparatus. Furthermore, when the drill rod is connected at the second end to a like drill rod, or to the fluid transfer device, the second planar end of the drill rod is in close proximity to the first planar end face of the like drill rod, or to the fluid transfer device. Preferably, the two faces are not brought into contact by the connection of the rods, but almost abut one another. In alternate embodiments, the fluid operated apparatus and fluid transfer devices further have an interface component with a planar end face.

In an embodiment, the first and second planar end faces are arranged such that upon connection of the drill rod to a like drill rod, or to the apparatus or to the fluid transfer device, the first planar end face of the drill rod is maintained in contact with the second planar end face of the like drill rod, or with the apparatus or with the fluid transfer device, whilst a pressure in the pressure fluid channel is higher than a pressure in the return fluid channel. The pressurisation of the hydraulic components brings the two planar faces into contact with each other.

Preferably, a face seal is provided in at least one of the first and second planar end faces, to effect a seal with the opposing end face. A face seal is a seal in which the sealing surfaces are normal to the axis of the seal, that is, it effects a seal by interacting primarily in a longitudinal or axial direction between the first and second end faces. The face seal may be provided in an annular recess on the first or second planar end face. The face seal may encircle at least one of the outlet for pressure fluid or the inlet for pressure fluid.

An advantage of this arrangement is that use of a face seal between two end faces which abut one another is significantly more tolerant of axial (parallel) misalignment between adjacent drill rods on connection than the radial seals in the prior art. This means that even if the central axes of adjacent rods are offset from one another on connection, a reliable seal can still be achieved. Face seals are also less prone to damage during connection than radial seals.

According to another aspect of the invention, there is provided a drill rod for a fluid-operated apparatus, the drill rod comprising:

a first connection interface at a first end and a second connection interface at a second end, wherein the first connection interface is for connection of the drill rod to a second connection interface of a like drill rod or to the apparatus, and the second connection interface is for connection of the drill rod to a first connection interface of a like drill rod or to a fluid transfer device;

at least one hydraulic component in the first connection interface, configured to carry pressure fluid through the drill rod and having an outlet for pressure fluid at an outwardly directed end thereof; and at least one hydraulic component in the second connection interface, configured to carry pressure fluid through the drill rod and having an inlet for pressure fluid at an outwardly directed end thereof;

wherein when the drill rod is connected to a like drill rod, or to the apparatus, or to the fluid transfer device, pressure fluid flows from the at least one hydraulic component in the first connection interface to the at least one hydraulic component in the second connection interface of the like drill rod or apparatus or fluid transfer device and there is no overlap between the hydraulic components in an axial direction of the drill rod.

In one embodiment, the first connection interface is a female connection interface and the second connection interface is a male connection interface. In alternate embodiments, this arrangement may be reversed. The drill rod of the present invention is ideally suited for use with a fluid-operated percussion drill tool such as a hydraulic down-the-hole hammer, but may also be used with any other fluid-powered device that needs to operate remotely. The fluid transfer device may also be a rotation device.

An embodiment of the invention will now be described with reference to the accompanying drawings.

DETAILED DESCRIPTION OF THE DRAWINGS

Figure 1:
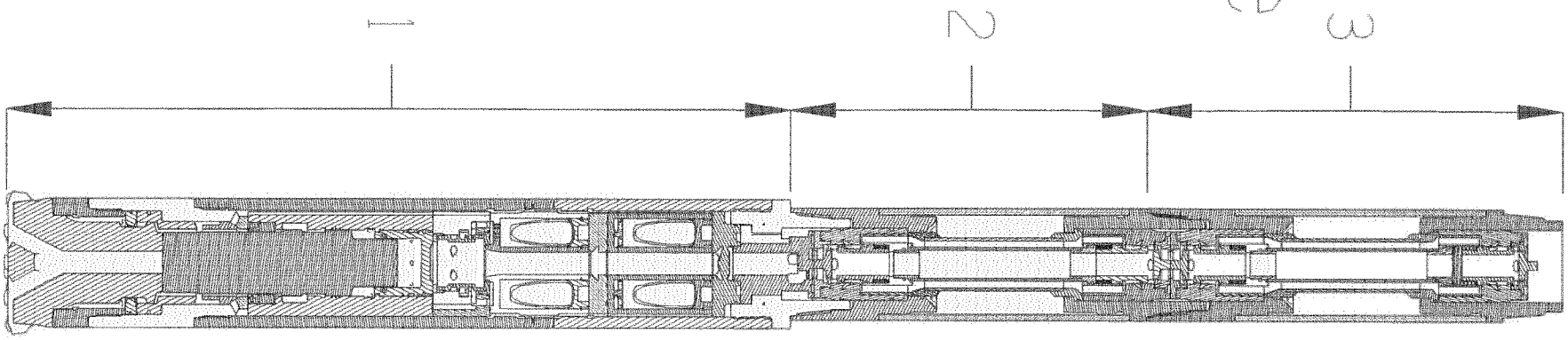
FIG. 1 is a cross-sectional view of a hydraulic down-the-hole drilling system, including drill rods according to the present invention.

A hydraulic down-the-hole drilling system incorporating two drill rods 2, 3 according to the present invention is shown in FIG. 1. The system includes a hammer 1, which is fed pressure fluid and flushing fluid and which discharges return fluid through drill rods 2, 3.

Figure 2:
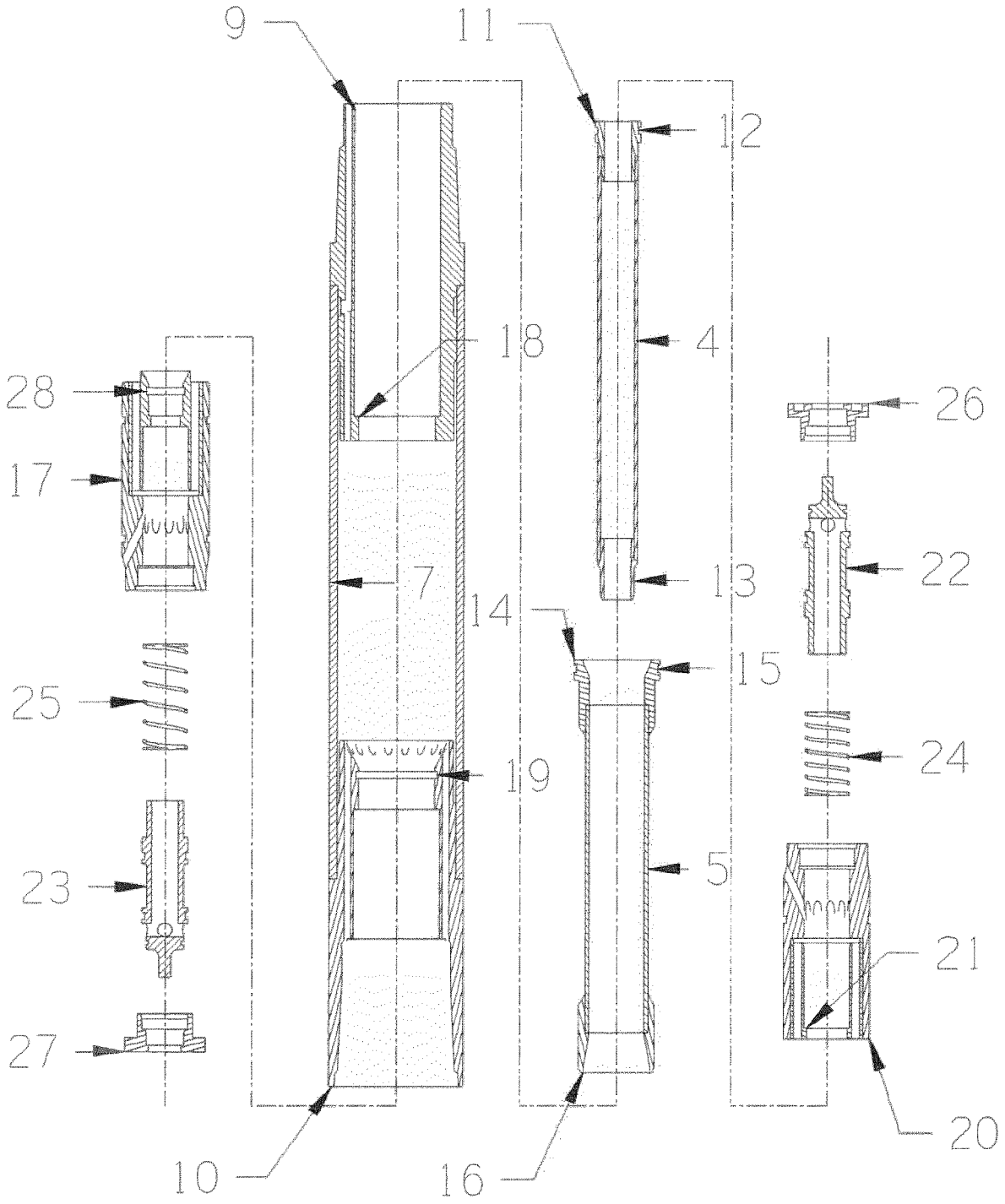
FIG. 2 is a cross-sectional view of the components of a drill rod according to an embodiment of the present invention, in a disassembled state.
Figure 3:
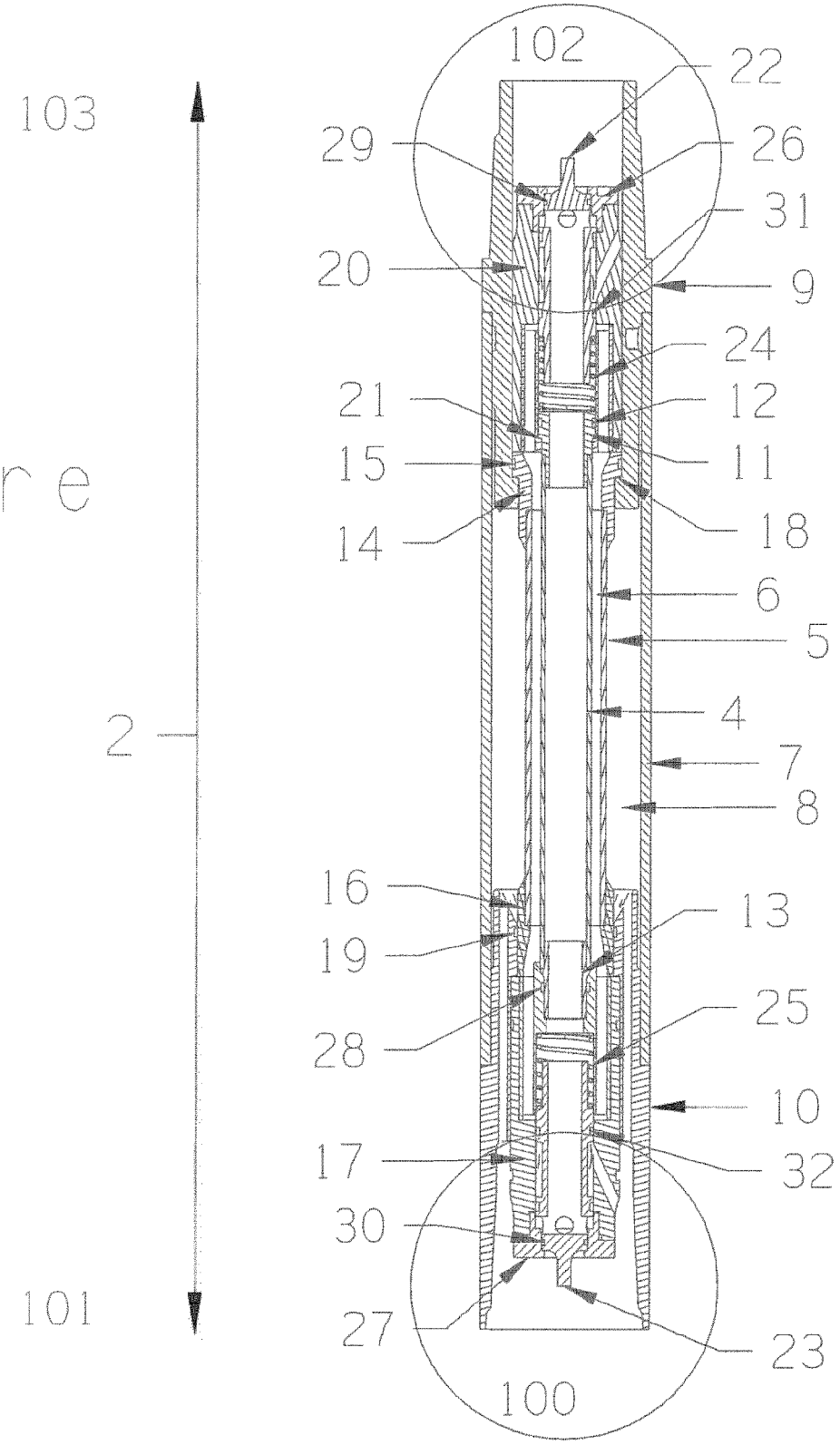
FIG. 3 is a cross-sectional view of the drill rod of FIG. 2, assembled.

FIGS. 2 and 3 show a drill rod 2 according to an embodiment of the present invention. The drill rod 2 has a female connection interface 100 at a first end 101 and a male connection interface 102 at a second end 103. The female connection interface 100 is for connection of the drill rod 2 to a male connection interface 102 of a like drill rod 3 or to the hammer 1, as shown in FIG. 1. The drill rod 2 has a plurality of discrete fluid flow channels 4, 6, 8 provided by a concentric tube structure. The drill rod comprises a centre tube 4, which carries pressure fluid, and which is surrounded by middle tube 5. Return fluid is carried in an annular channel 6 between centre tube 4 and the middle tube 5. The middle tube is surrounded by outer tube 7. Flushing fluid is carried in an annular channel 8 between middle tube 5 and outer tube 7.

The female connection interface 100 includes a strengthened housing or female tool joint 10 welded to a first end of outer tube 7. The female tool joint 10 is generally cylindrical in form and has an internal bore provided therein. A tapered thread is provided on an inner wall of the female tool joint 10. The male connection interface 102 includes a strengthened housing or male tool joint 9 welded to a second end of the outer tube 7. The male tool joint 9 is generally cylindrical in form and has a tapered thread provided on an outer wall thereof. The female tool joint 10 is for threaded connection of the drill rod 2 to the male tool joint 9 of a like drill rod or to the hammer 1, and the male tool joint 9 is for threaded connection to a female tool joint 10 of a like drill rod 3 or to a rotation device, as shown in FIG. 1. In alternate embodiments, the tool joints 9 and 10 may be fixed to the outer tube 7 by means other than welding.

An end piece 13 is provided at a first end of centre tube 4. At a second end of the centre tube 4, a seal carrier 11 is welded to the tube and fitted with a seal 12. Similarly, an end piece 16 is welded to a first end of middle tube 5 and a seal carrier 14, fitted with a seal 15, is welded to a second end of middle tube 5. In alternate embodiments, the end pieces may be fixed to the centre and middle tubes by means other than welding.

The drill rod 2 is assembled by first pushing a female hydraulic insert 17 into the female tool joint 10 until an end of the insert 17 abuts an inwardly directed shoulder in the female tool joint 10. The middle tube 5 is then fed into the outer tube 7 through the male tool joint 9 until the seal carrier 14 abuts an inwardly directed shoulder 18 in the male tool joint 9. The seal 15 engages the internal wall of the tool joint 9. When the middle tube 5 is in position, its end piece 16 engages a radial seal 19 provided in a circumferential groove in the internal wall of female tool joint 10. A male hydraulic insert 20 is then pushed into the male tool joint 9 until it abuts seal carrier 14. The centre tube 4 is then fed in through the male hydraulic insert 20 until its seal carrier 11 engages an inwardly directed shoulder 21 provided on hydraulic insert 20. Once the centre tube is in position, its end piece 13 engages a radial seal 28 provided in a circumferential groove in hydraulic insert 17. As shown in FIG. 3, when the tubes are assembled, the outer tube 7 extends axially beyond the ends of the middle tube and the centre tube.

The drill rod further comprises a female control spool 23 moveably mounted in the female connection interface 100 and a male control spool 22 moveably mounted in the male connection interface 102. The female control spool 23 is biasedly mounted in the female connection interface 100 by way of spring 25 and the male control spool is biasedly mounted in the male connection interface 102 by way of spring 24. As shown in FIG. 3, the female control spool 23 is the innermost component in the female connection interface 100 and the male control spool 22 is the innermost component in the male connection interface 102, that is, no other component is disposed or received within either of the control spools 22, 23.

To complete the assembly, control spools 22 and 23 with their springs 24 and 25 are fed into the male 20 and female 17 hydraulic inserts, respectively, and male 26 and female 27 spool stops are screwed into the male 20 and female 17 hydraulic inserts, respectively. Each of spool stops 26, 27 has a substantially planar end face. Spool stop 27 has an outlet for pressure fluid in its end face and spool stop 26 has an inlet for pressure fluid in its end face. A face seal 34 is provided in an annular recess in the planar end face of spool stop 26, wherein the face seal 34 encircles the inlet for pressure fluid. The threads on these spool stops 26, 27 are made with additional axial clearance so that the spool stops 26, 27 can move a small amount in an axial direction. When 'energised' by the application of pressure the spool stops 26, 27 are brought into contact with each other. Seals 29 and 30 on control spools 22 and 23 ensure that oil contained in centre tube 4 cannot leak externally from the drill rod when the drill rod is disconnected from another drill rod. Seals 31 and 32 on control spools 22 and 23 ensure that oil contained in the annular return flow path 6 cannot leak externally upon disconnection. Thus, when the drill rod is disconnected from like drill rods or the drill tool, the pressure and return fluid flow channels are sealed by the male and female control spools.

Once fully assembled, the centre 4 and middle 5 tubes are fixed in position, due to their engagement with shoulders 21 and 18, respectively, in the male connection interface 102 only. The end pieces 13 and 16 at the opposite ends of the tubes are free to move axially within the seals 28 and 19. This allows for slight length variations in the tubes if they are ever individually replaced, and more importantly, also allows for differential thermal or pressure induced changes in length of the various tubes during operation.

Figure 4:
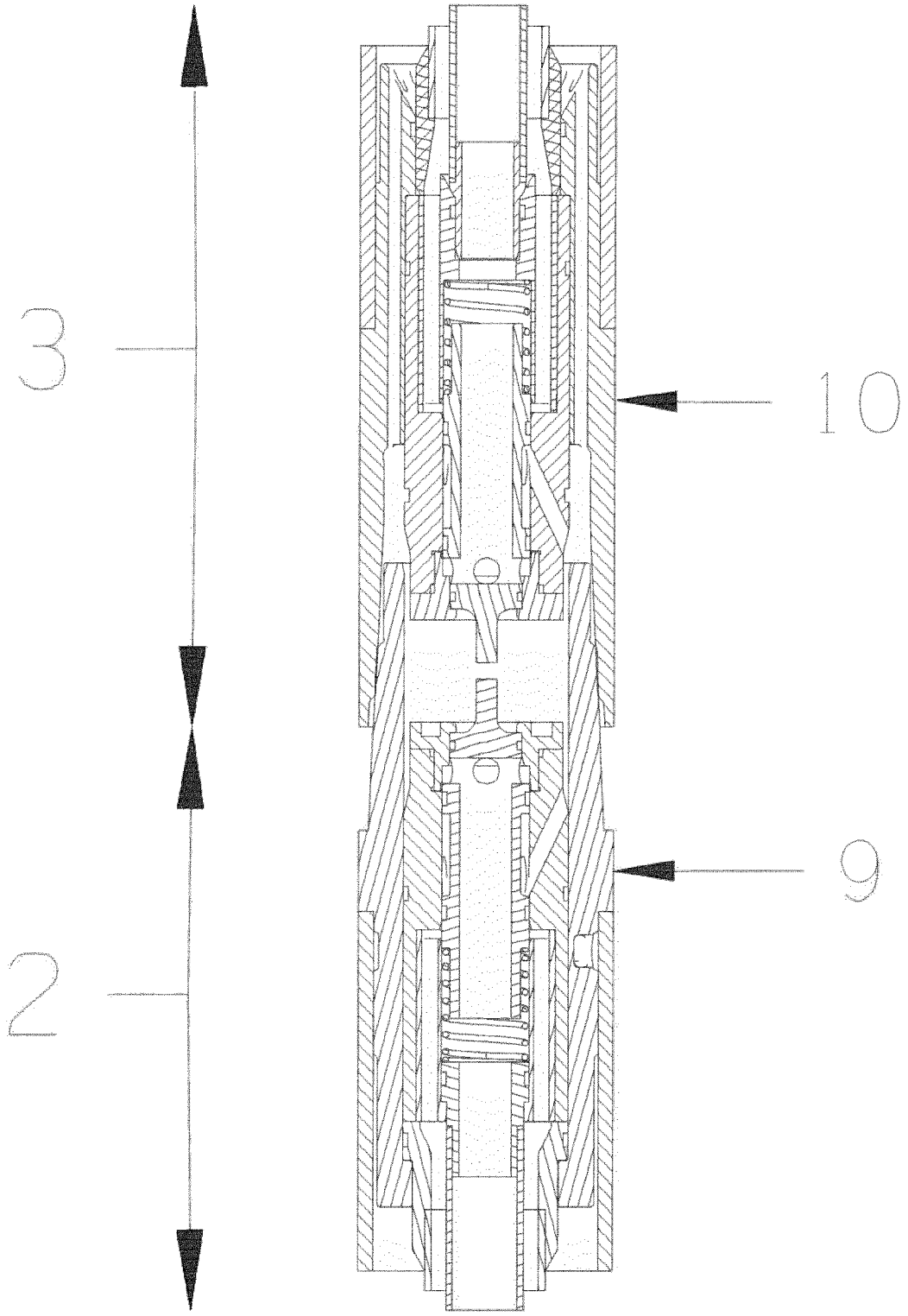
FIG. 4 is a cross-sectional view of two adjacent drill rods coming together to make a connection.

As shown in FIG. 4, adjacent drill rods 2, 3 are joined together by engaging the threads of the female tool joint 10 on drill rod 3 with the threads of the male tool joint 9 on drill rod 2, and by rotating rod 3 relative to rod 2.

Figure 5:
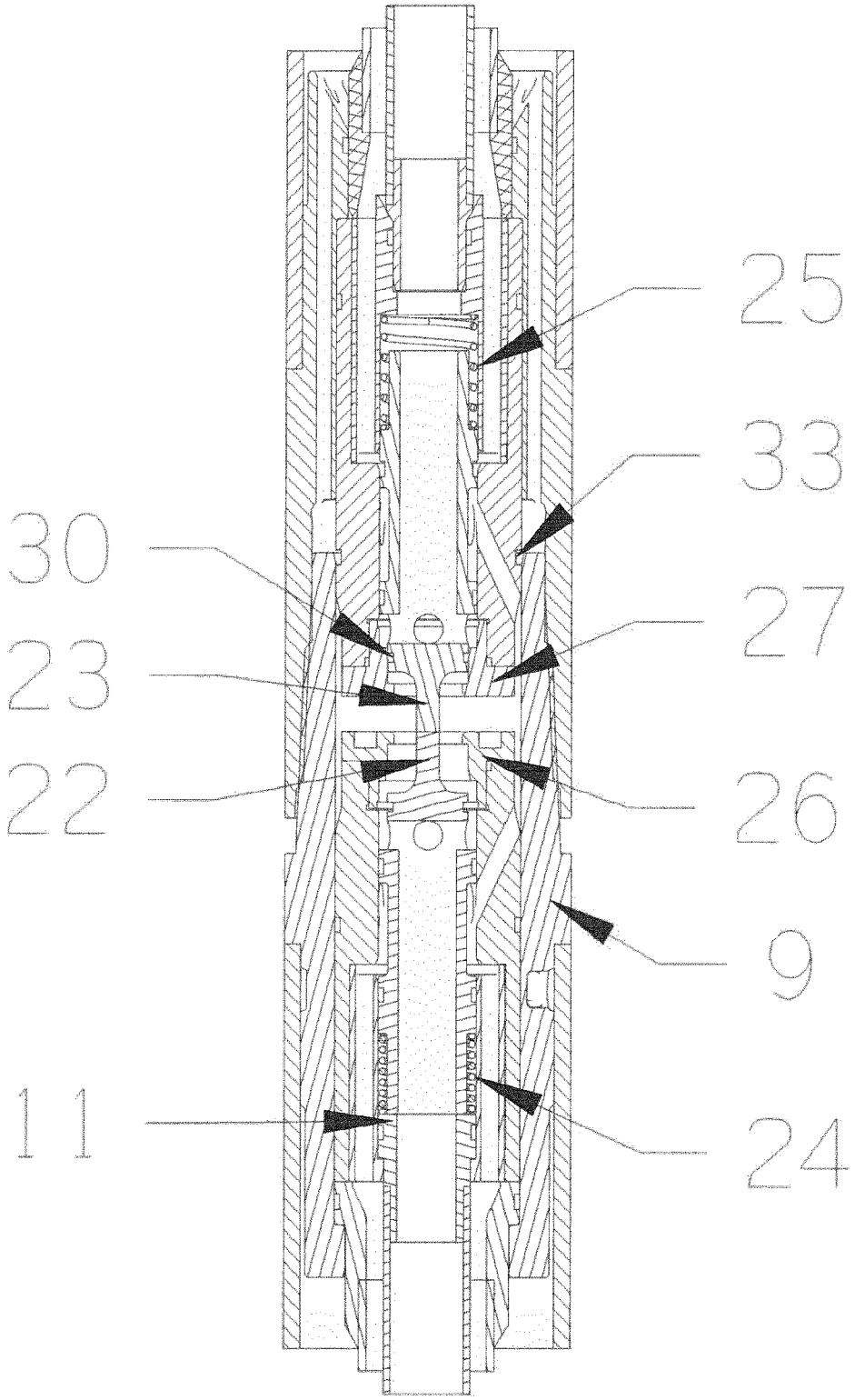
FIG. 5 is a cross-sectional view of the drill rods of FIG. 4, partially engaged.

As shown in FIG. 5, as the rods come together, control spools 22 and 23 come into contact with one another. As shown in the drawings, each of the control spools has a substantially planar end face, and when the drill rods are brought together, the planar end faces abut one another. Spring 25 applies a higher preload force to female control spool 23 than spring 24 applies to male spool 22. Continued engagement of the threaded connection between the drill rods causes male spool 22 to move away from its spool stop 26 until it contacts seal carrier 11 on centre tube 4, at which point no further movement is possible. Further engagement of the connection causes female control spool 23 to move away from its spool stop 27. At the point shown in FIG. 5, male control spool 22 has moved as far as it can and is in contact with seal carrier 11 and female control spool 23 is just about to disengage from spool stop 27. As the female connection interface is at the upstream side of the connection, when the female spool 23 moves off the spool stop 27, oil from centre tube 4 will be released from rod 3 to flood the connection area. This ensures that the connection area is well lubricated prior to the final portion of its travel. At this same position, radial seal 33 provided in a circumferential groove on an outer wall of female hydraulic insert 17 engages with the nose of the male tool joint 9 to ensure that the fluid that floods the connection area cannot leak externally.

Figure 6:
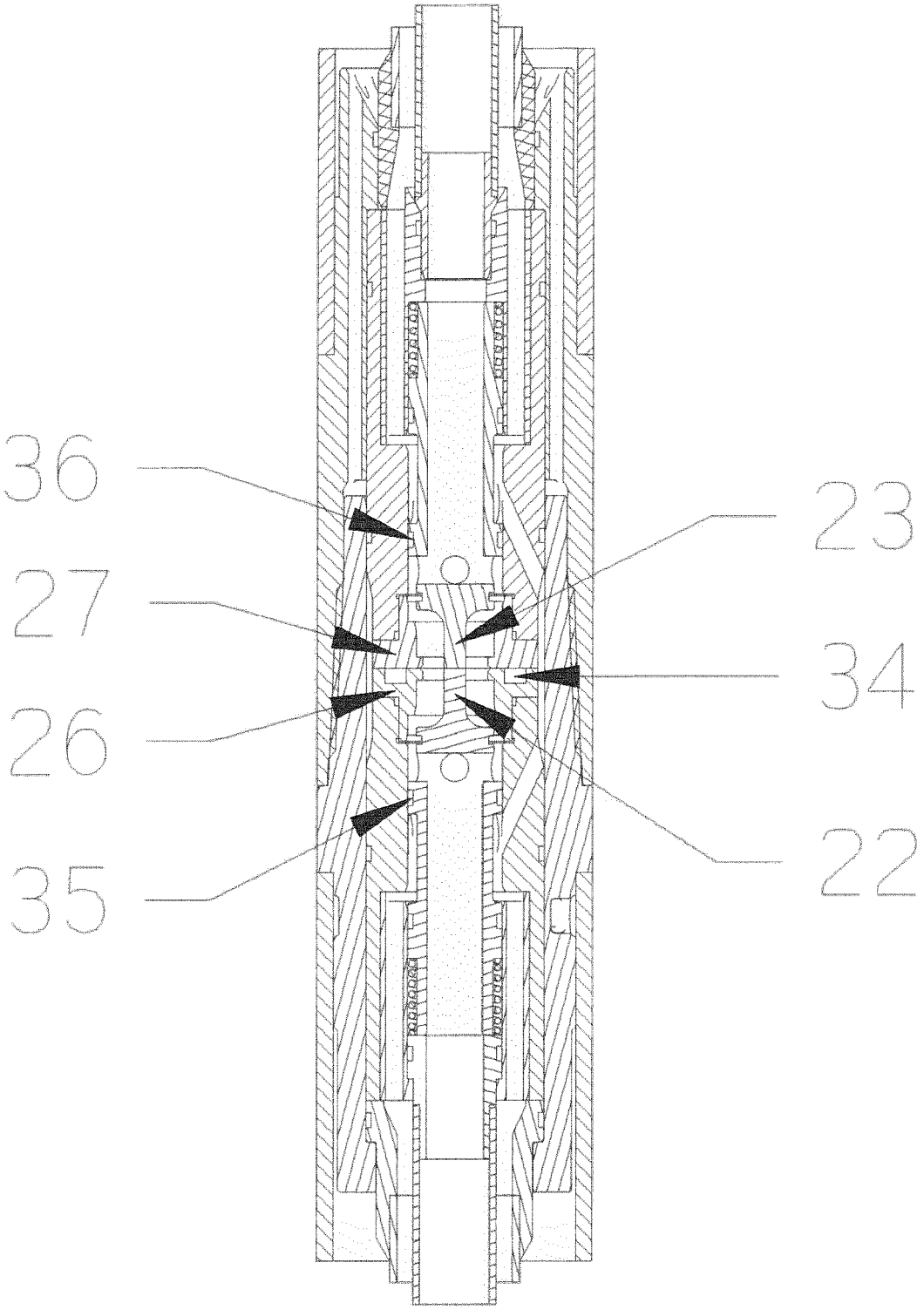
FIG. 6 is a cross-sectional view of the drill rods of FIG. 4, fully engaged.
Figure 7:
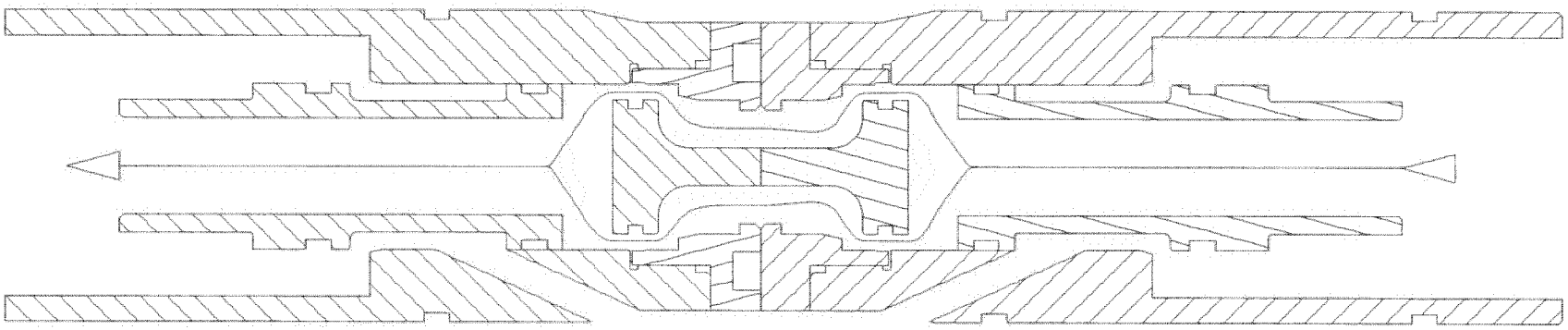
FIG. 7 is a cross-sectional view of a portion of the drill rods of FIG. 6, illustrating the pressure fluid flow path through the connection.
Figure 8:
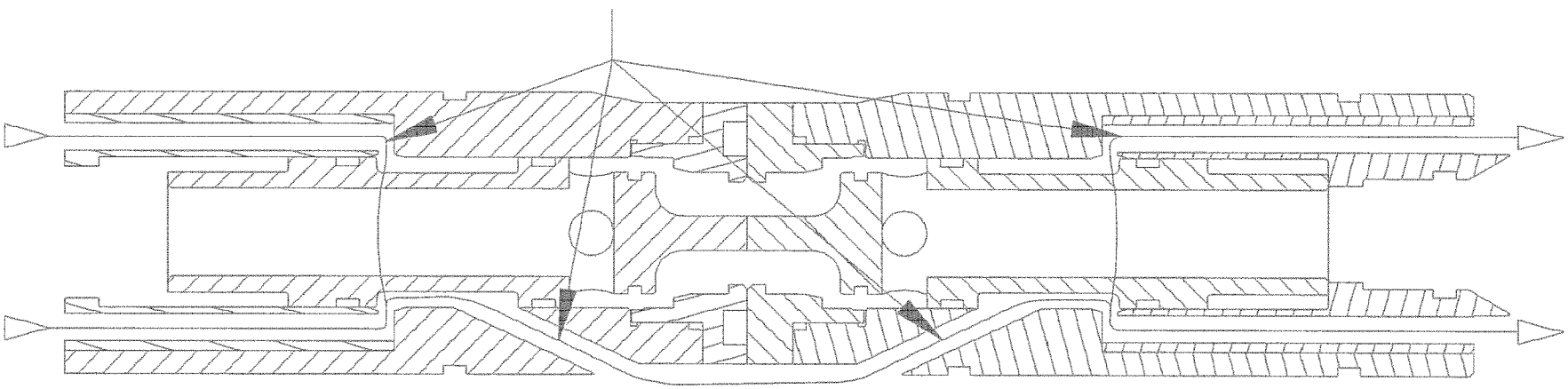
FIG. 8 is a cross-sectional view of a portion of the drill rods of FIG. 6, illustrating the return fluid flow path through the connection.

As shown in FIG. 6, when the connection is fully engaged, the two spool stops 26, 27 come into very close proximity to each other. The planar end faces of the spool stops abut one another and as shown in the drawing, there is no overlap in a longitudinal or axial direction between either the moveable control spools 22, 23 or the spool stops 26, 27. Face seal 34 on male spool stop 26 engages the planar end face of female spool stop 27 and provides a seal around the pressure fluid flow path at the interface between the drill rods 2,3. In the position shown in FIG. 6, the female spool 23 has moved away from its stop 27 by the same distance as male spool 22 from its stop 26, so that the pressure 4 and return 6 fluid flow channels of drill rod 3 are placed in fluid communication with the corresponding channels of drill rod 2 by movement of the control spools only. As shown in FIGS. 7 and 8, the flow channels are substantially symmetrical.

As shown in FIGS. 7 and 8, movement of the spools 22, 23 away from their stops 26, 27 opens the pressure and return fluid flow paths substantially simultaneously. The pressure fluid flows through centre tube 4 of drill rod 3 and female control spool 23 and into male control spool 22 and centre tube 4 of drill rod 2. The return fluid flows from annular channel 6 in drill rod 2, into a recess in the outer wall of control spool 22, through multiple drillings in hydraulic insert 20 and then between male tool joint 9 and hydraulic inserts 20 and 17, through drillings in hydraulic insert 17 in drill rod 3, into a recess in the outer wall of control spool 23 and into annular channel 6 in drill rod 3. Upon disconnection, the reverse occurs and the flow paths are closed substantially simultaneously, just before the nose of the male tool joint 9 disengages from seal 33. This ensures that there is no significant loss of hydraulic fluid with each connection/disconnection cycle.

Figure 9:
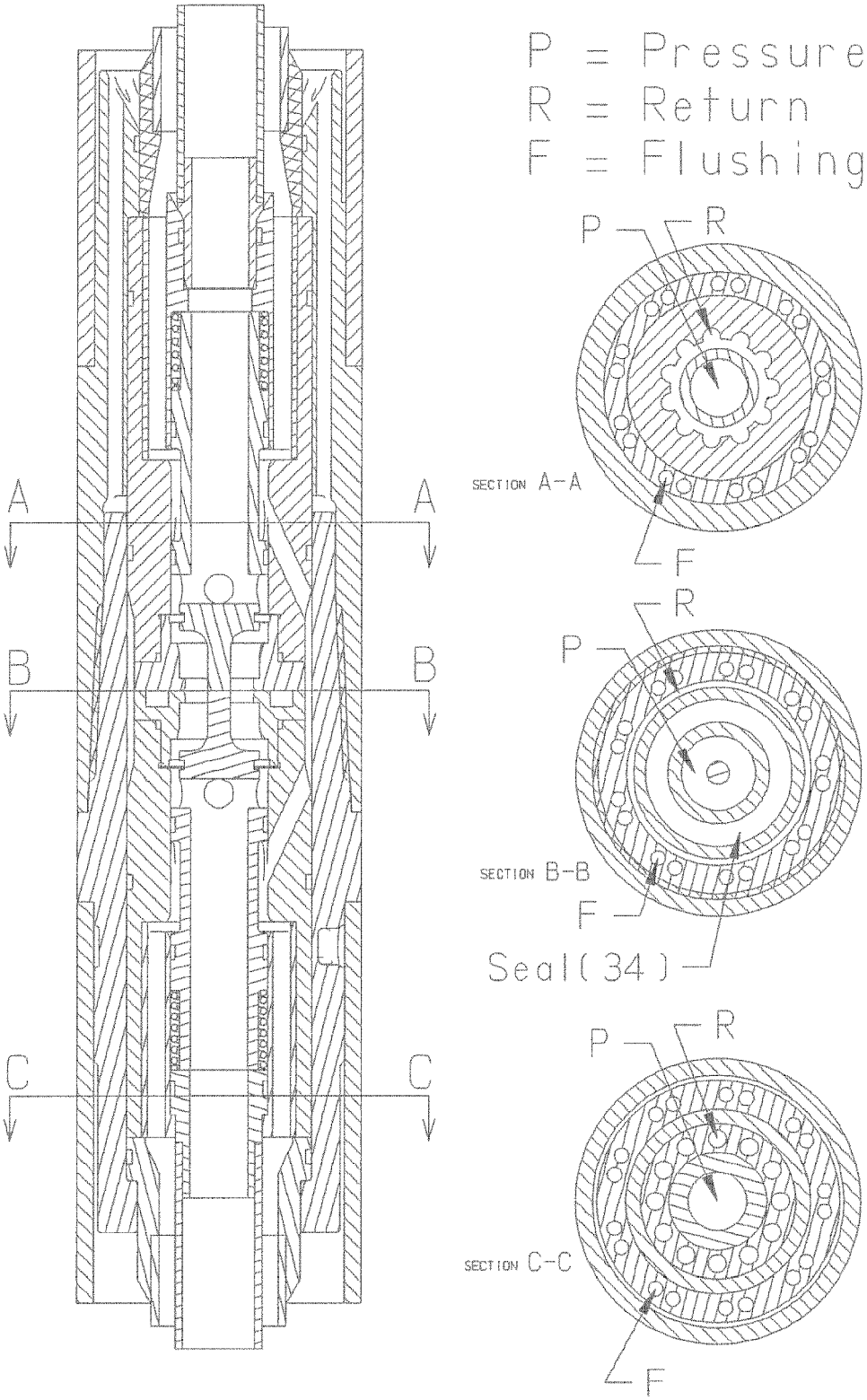
FIG. 9 is a cross-sectional view of FIG. 6.

The transverse cross-sections of FIGS. 9*a* to 9*c* show the flushing channels in the form of longitudinal drillings though the male 9 and female 10 tool joints and the return channel drillings in the hydraulic inserts 17, 20.

As set out above, there is only one moveable component in each connection interface, namely, the control spool and there is no overlap between the control spools in an axial direction, i.e. neither moveable component is received within the other. Each moveable component is the innermost component of the connection interface. The movement of the control spools controls both working fluid flows in each half of the connection.

In the embodiment shown in the drawings and described above, pressure fluid flows from a female connection interface in one drill rod to a male connection interface in an adjoining drill rod. In alternate embodiments, the connection interfaces may be reversed so that pressure fluid flows from a male connection interface in one drill rod to a female connection interface in an adjoining drill rod. The only alteration required to the drill rod for this embodiment would be reversal of the springs 24 and 25.

There are a number of advantages associated with this design. It allows a strong tool joint configuration, using industry standard tapered threads, which allow the tool joints to engage and guide the connection together even where there is initial parallel misalignment. The hydraulic inserts within the tool joints can be made so that the opposing tool joint cannot contact them during at least the first 80% of thread engagement, even where there is significant angular misalignment. If no contact between these components is possible, then no wear or damage can be causes, greatly improving the reliability of the connection over prior art designs. As set out above and as shown in FIG. 5, there is no engagement between the male tool joint and the female hydraulic insert until the male control spool has reached its fully displaced position, at which point the nose of the male tool joint 9 engages with seal 33 on female hydraulic insert 17. Furthermore, because minimal cross-sectional area is taken up by the control spools, the hydraulic inserts may be made very strong, with a cross sectional area and bending strength that is comparable to that of the tool joints. This further enhances reliability. The area available to each flow path, at the tool joints, can be kept as high as 20% of the total internal cross-sectional area of the tool joint, without compromising reliability. This reduces pressure losses at each connection between adjacent drill rods.

The use of a face seal instead of a radial seal at the pressure flow path connection provides a number of further advantages. It is far less susceptible to damage or wear during engagement, since there is no movement of components over the seal. It can tolerate significant parallel misalignment, and more angular misalignment that a radial seal. The surface of the female control spool stop that engages the seal never touches any other component, even when the connection is misaligned. This ensures that it cannot suffer wear or damage that might affect the reliability of the seal between the spool stops. The (slight) axial movement of the spool stops 26, 27 to contact each other while under pressure ensures that the face seal 34 operates with no extrusion gap, enhancing its reliability further.

The radial seal 33 in the outer wall of the hydraulic insert 17 is subjected to low pressure return fluid only, and its engagement length with the male tool joint is very short, approximately 10% of the rod diameter. This improves the reliability of the seal, since the male tool joint moves over the seal for only a small portion of the overall thread engagement length.

Because the end pieces of tubes 4 and 5 are received within radial seals and are not fixed in place, the design allows for differential thermal expansion of these components.

The drill rod is fully modular and each component can be individually replaced, as necessary.

The concentric tube structure ensures that any small amounts of fluid that leak from the pressure channel during operation are fully contained in the return channel, thereby ensuring that no working fluid is lost. This arrangement also contains the working fluid in the event of a seal failure anywhere in the pressure channel.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Having described the invention, the following is claimed:

1. A fluid-operated drilling apparatus, comprising:

at least three separate components configured to interconnect with each other, the at least three separate components comprising at least one drill rod, the drill rod comprising:

a first connection interface at a first end and a second connection interface at a second end, the first connection interface being configured to connect the drill rod to a second connection interface of a second of the at least three separate components, the second connection interface being configured to connect the drill to a first connection interface of a third of the at least three separate components;

a plurality of discrete fluid flow channels through the drill rod;

a first member moveably mounted in the first connection interface, the first moveable member being an innermost member of the first connection interface and the only moveable member in the first connection interface; and a second member moveably mounted in the second connection interface, the second moveable member being an innermost member of the second connection interface and the only moveable member in the second connection interface, wherein, when the first connection interface of the drill rod is connected to the second connection interface of the second of the at least three separate components, and the second connection interface of the drill rod is connected to the first connection interface of the third of the at least three separate components, at least two of the fluid flow channels in the drill rod are placed in fluid communication with respectively corresponding fluid flow channels of the second and third of the at least three separate components only by connectable movement of:

the first moveable member of the drill rod with a moveable member of the second connection interface of the second of the at least three separate components;

the second moveable member of the drill rod with a moveable member of the first connection interface of the third of the at least three separate components; and there is no overlap between the moveable members in an axial direction of the drill rod.

2. A drilling apparatus as claimed in claim 1, wherein the first moveable member of the drill rod is biasedly mounted in the first connection interface and the second moveable member of the drill rod is biasedly mounted in the second connection interface, wherein, when the first connection interface of the drill rod is not connected to the second connection interface of the second of the at least three separate components, and the second connection interface of the drill rod is not connected to the first connection interface of the third of the at least three separate components, the at least two fluid flow channels are sealed by the first and second moveable members.

3. A drilling apparatus as claimed in claim 1, wherein, over at least a portion of a length of the drill rod, the plurality of discrete fluid flow channels are concentrically arranged.

4. A drilling apparatus as claimed in claim 1, wherein the at least two of the fluid flow channels in the drill rod and the respectively corresponding fluid flow channels of the second and third of the at least three separate components each include at least a pressure fluid channel and a return fluid channel, wherein, when the first connection interface of the drill rod is connected to the second connection interface of the second of the at least three separate components, and the second connection interface of the drill rod is connected to the first connection interface of the third of the at least three separate components, the pressure fluid channel and the return fluid channel of the the drill rod are respectively in fluid communication with respectively corresponding pressure fluid channels and return fluid channels of the second and third of the at least three separate components, and wherein, when the first connection interface of the drill rod is not connected to the second connection interface of the second of the at least three separate components, and the second connection interface of the drill rod is not connected to the first connection interface of the third of the at least three separate components, the pressure fluid channel and the return fluid channel of the drill rod are sealed by the first and second moveable members of the drill rod.

5. A drilling apparatus as claimed in claim 1, wherein the drill rod further comprises:

an outer tube;

a middle tube, concentrically mounted within the outer tube; and a centre tube, concentrically mounted within the middle tube, wherein the tubes provide three of the discrete fluid flow channels through the drill rod, and wherein the outer tube extends axially beyond ends of the middle tube and the centre tube.

6. A drilling apparatus as claimed in claim 5, wherein the first connection interface of the drill rod includes a female tool joint having a tapered thread at a first end of the outer tube, wherein the second connection interface of the drill rod includes a male tool joint having a tapered thread at a second end of the outer tube, wherein the female tool joint in the drill rod is configured to threadably connect to a male tool joint of the second of the at least three separate components, and wherein the male tool joint in the first one of the drill rods is configured to threadably connect to a female tool joint of the third of the at least three separate components.

7. A drilling apparatus as claimed in claim 5, wherein the first connection interface of the drill rod includes a male tool joint having a tapered thread at a first end of the outer tube, wherein the second connection interface of the drill rod includes a female tool joint having a tapered thread at a second end of the outer tube, wherein the male tool joint of the drill rod is configured to threadably connect to a female tool joint of the second of the at least three separate components, and wherein the female tool joint in the first one of the drill rods is threadably connected to the male tool joint of the third of the at least three separate components.

8. A drilling apparatus as claimed in claim 1, wherein the drill rod further comprises:

at least one first hydraulic element in the first connection interface, the first hydraulic element being configured to carry pressure fluid through the drill rod, the first hydraulic element having an outlet for pressure fluid at an outwardly directed end thereof; and at least one second hydraulic element in the second connection interface, the second hydraulic element being configured to carry pressure fluid through the drill rod, the second hydraulic element having an inlet for pressure fluid at an outwardly directed end thereof, and wherein, when the first connection interface of the drill rod is connected to the second connection interface of the second of the at least three separate components, and the second connection interface of the drill rod is connected to the first connection interface of the third of the at least three separate components:

pressure fluid flows from the at least one first hydraulic element in the first connection interface of the drill rod to at least one hydraulic element in the second connection interface of the second of the at least three separate components;

return fluid flows from the at least one second hydraulic element in the second connection interface of the drill rod to at least one hydraulic element in the first connection interface of the third of the at least three separate components; and there is no overlap between the first and second hydraulic elements in an axial direction of the drill rod.

9. A drilling apparatus as claimed in claim 8, wherein the at least one first hydraulic element in the first connection interface of the drill rod has a first planar end face, wherein the at least one second hydraulic element in the second connection interface of the drill rod has a second planar end face, and wherein, when the first connection interface of the drill rod is connected to the second connection interface of the second of the at least three separate components, and the second connection interface of the drill rod is connected to the first connection interface of the third of the at least three separate components:

the first planar end face of the at least one first hydraulic element in the first connection interface of the drill rod is in close proximity to a planar end face of the second connection interface of the second of the at least three separate components; and the second planar end face of the at least one second hydraulic element in the second connection interface of the drill rod is in close proximity to a planar end face of the first connection interface of the third of the at least three separate components.

10. A drilling apparatus as claimed in claim 9, wherein a face seal is provided on at least one of the first and second planar end faces of the drill rod.

11. A drilling apparatus as claimed in claim 10, wherein the face seal is provided in an annular recess on the first or second planar end face of the drill rod.

12. A drilling apparatus as claimed in claim 10, wherein the face seal encircles at least one of the outlet for the pressure fluid in the first hydraulic element and the inlet for the pressure fluid in the second hydraulic element.

13. A fluid-operated drilling apparatus, comprising:

at least three separate components configured to interconnect with each other, the at least three separate components comprising at least one drill rod, the drill rod comprising:

a first connection interface at a first end and a second connection interface at a second end;

a plurality of discrete fluid flow channels through the drill rod, the discrete fluid flow channels comprising at least a pressure fluid channel;

at least one first spool stop in the first connection interface, the first spool stop defining at least a part of the pressure fluid channel through the drill rod, the first spool stop having an outlet for pressure fluid at an outwardly directed end thereof and having a first planar end face; and at least one second spool stop in the second connection interface, the second spool stop defining at least a part of the pressure fluid channel through the drill rod, the second spool stop having an inlet for pressure fluid at an outwardly directed end thereof and having a second planar end face, wherein, when the first connection interface of the drill rod is connected to a second connection interface of the second of the at least three separate components, and the second connection interface of the drill rod is connected to a first connection interface of the third of the at least three separate components:

pressure fluid flows through the at least one first spool stop in the first connection interface of the drill rod and through at least one hydraulic element in the second connection interface of the second of the at least three separate components;

pressure fluid flows through at least one hydraulic element in the first connection interface of the third of the at least three separate components and through the at least one second spool stop in the second connection interface of the drill rod; and in an axial direction of the drill rod:

there is no overlap between the first spool stop and the hydraulic element in the second connection interface of the second of the at least three separate components; and there is no overlap between the second spool stop and the hydraulic element in the first connection interface of the third of the at least three separate components.

14. A drilling apparatus as claimed in claim 13, wherein the discrete fluid flow channels further comprise a return flow channel, and wherein, when the first connection interface of the drill rod is connected to the second connection interface of the second of the at least three separate components, and the second connection interface of the drill rod is connected to the first connection interface of the third of the at least three separate components, the pressure fluid channel and the return fluid channel of the drill rod are respectively in fluid communication with corresponding pressure and return fluid channels of the second of the at least three separate components and corresponding pressure and return fluid channels of the third of the at least three separate components.

15. A drilling apparatus as claimed in claim 13, wherein, when the first connection interface of the drill rod is connected to the second connection interface of the second of the at least three separate components, and the second connection interface of the drill rod is connected to the first connection interface of the third of the at least three separate components:

the first planar end face of the at least one first spool stop in the first connection interface of the drill rod is in close proximity to a planar end face of the second connection interface of the second of the at least three separate components; and the second planar end face of the at least one second spool stop in the second connection interface of the drill rod is in close proximity to a planar end face of the first connection interface of the third of the at least three separate components.

16. A drilling apparatus as claimed in claim 14, wherein, when the first connection interface of the drill rod is connected to the second connection interface of the second of the at least three separate components, and the second connection interface of the drill rod is connected to the first connection interface of the third of the at least three separate components:

the first planar end face of the at least one first spool stop in the first connection interface of the drill rod is maintained in contact with a planar end face of the second connection interface of the second of the at least three separate components;

the second planar end face of the at least one second spool stop in the second connection interface of the drill rod is maintained in contact with the a planar end face of the first connection interface of the third of the at least three separate components; and a pressure in the pressure fluid channel is higher than a pressure in the return fluid channel.

17. A drilling apparatus as claimed in claim 15, wherein a face seal is provided on at least one of the first and second planar end faces of the drill rod.

18. A drilling apparatus as claimed in claim 13, wherein the drill rod further comprises a first control spool and a second control spool, the first control spool being moveably mounted in the first connection interface of the drill rod to extend through the first spool stop, the second control spool being moveably mounted in the second connection interface of the drill rod to extend through the second spool stop, and wherein, when the first connection interface of the drill rod is connected to the second connection interface of the second of the at least three separate components, and the second connection interface of the drill rod is connected to the first connection interface of the third of the at least three separate components:

pressure fluid flows through the at least one first spool stop and around the first control spool in the first connection interface of the drill rod and through the at least one hydraulic element in the second connection interface of the second of the at least three separate components;

pressure fluid flows through the at least one hydraulic element in the first connection interface of the third of the at least three separate components and through the at least one second spool stop and around the second control spool in the second connection interface of the drill rod; and there is no overlap between the first control spool and the second control spool in the axial direction of the drill rod.

19. A drilling apparatus as claimed in claim 17, wherein the face seal encircles at least one of the outlet for the pressure fluid in the first hydraulic element and the inlet for the pressure fluid in the second hydraulic element.

20. A drilling apparatus as claimed in claim 1, further comprising:

a hammer configured to drill holes and connect to the first connection interfaces of the at least three separate components; and a fluid transfer device configured to transfer fluid to the hammer via the drill rod and connect to the second connection interfaces of the at least three separate components.

21. A drill rod for a fluid-operated drilling apparatus, the drill rod comprising:

a female connection interface at a first end, the female connection interface comprising a female tool joint, the female tool joint having an internal bore formed therethrough and a tapered thread provided on an inner wall thereof, a female hydraulic insert being disposed in the female tool joint, an end of the female hydraulic insert abutting an inwardly directed shoulder in the female tool joint;

a male connection interface at a second end, the male connection interface comprising a male tool joint, the male tool joint having a tapered thread provided on an outer wall thereof, a male hydraulic insert being disposed in the male tool joint;

a plurality of discrete fluid flow channels provided by a concentric tube structure, the tube structure comprising:

a center tube defining one of the discrete fluid flow channels, the center tube being configured to carry pressure fluid therethrough, the center tube having a center end piece provided at a first end thereof and a center seal carrier fitted with a center seal and fixed to a second end thereof, the center seal carrier engaging an inwardly directed shoulder provided on the male hydraulic insert, the center end piece engaging a center radial seal provided in a circumferential groove in the male hydraulic insert, the center end piece being free to move axially within the center radial seal;

a first annular channel defined between the center tube and a middle tube surrounding the center tube, the first annular channel being configured to carry return fluid therethrough, the middle tube having a first end piece fixed to a first end thereof and a first seal carrier fitted with a first seal that engages an internal wall of the male tool joint, the first seal carrier being welded to a second end thereof, the first seal carrier abutting an inwardly directed shoulder in the male tool joint, the first end piece engaging a first radial seal provided in a circumferential groove in an internal wall of the female tool joint, the first end piece being free to move axially within the first radial seal, the male hydraulic insert abutting the first seal carrier; and a second annular channel defined between the middle tube and an outer tube surrounding the middle tube, the outer tube extending axially beyond the first and second ends of the center tube and the first and second ends of the middle tube, the second annular channel being configured to carry flushing fluid therethrough, a first end of the outer tube being fixed to the female tool joint, a second end of the outer tube being fixed to the male tool joint;

a female control spool moveably and biasedly mounted in the female connection interface by way of a female spring, the female control spool being an innermost component in the female connection interface, the female control spool having a female control spool stop that is fastened to the female hydraulic insert, the female control spool stop having an outlet for pressure fluid in an end face thereof; and a male control spool moveably and biasedly mounted in the male connection interface by way of a male spring, the male control spool being an innermost component in the male connection interface, the male control spool having a male control spool stop that is fastened to the male hydraulic insert, the male control spool stop having an inlet for pressure fluid in an end face thereof and a face seal provided in an annular recess in the end face thereof, the face seal of the male control spool stop encircling the inlet for pressure fluid, wherein the male and female control spool stops are configured to move and contact one another when pressure is applied to the male and female control spool stops.

22. A drilling apparatus as claimed in claim 1, wherein the fluid flow channels are configured to open when the drill rod is connected to the second and third of the at least three separate components.

* * * * *